US012137752B2

(12) United States Patent
Ferguson

(10) Patent No.: US 12,137,752 B2
(45) Date of Patent: Nov. 12, 2024

(54) SOCK PAIRING SYSTEM

(71) Applicant: Darrian L. Ferguson, Sherman Oaks, CA (US)

(72) Inventor: Darrian L. Ferguson, Sherman Oaks, CA (US)

( * ) Notice: Subject to any disclaimer, the term of this patent is extended or adjusted under 35 U.S.C. 154(b) by 71 days.

(21) Appl. No.: 17/678,850

(22) Filed: Feb. 23, 2022

(65) Prior Publication Data

US 2022/0279863 A1 Sep. 8, 2022

Related U.S. Application Data

(60) Provisional application No. 63/153,738, filed on Feb. 25, 2021.

(51) Int. Cl.
*A41B 11/00* (2006.01)

(52) U.S. Cl.
CPC ..... *A41B 11/002* (2013.01)

(58) Field of Classification Search
CPC . A41B 11/002; A41B 11/006; A41D 19/0093; A41D 27/205
See application file for complete search history.

(56) References Cited

U.S. PATENT DOCUMENTS 1,117,591 A * 11/1914 Morningstar ..... A41B 11/006 D2/983
1,426,797 A * 8/1922 Wangelin ..... A41D 19/0037 2/160
2,621,501 A * 12/1952 Jenkins ..... D06H 1/00 66/171
2,663,877 A * 12/1953 Bohman ..... D06F 95/008 2/239
2,814,807 A * 12/1957 Dollar ..... A41B 11/006 2/239
2,890,461 A * 6/1959 Hartman ..... A41B 11/006 2/247
3,121,233 A * 2/1964 Rothman ..... A41B 3/02 2/116

(Continued)

FOREIGN PATENT DOCUMENTS

CN 201691071 U 1/2011
JP 2012102447 A 5/2012

OTHER PUBLICATIONS

""I Can Do It!" Socks by EZ SOX—Zoo Pack Seamless Socks w/Loops for Boys & Girls—2 Pairs," Copyright @ 2021 www.kidssocks.com: http://www.kidssocks.com/EZ-SOX-Zoo-Pack-Seamless-Socks-p/pk8ml.htm.

*Primary Examiner* — Jillian K Pierorazio
(74) *Attorney, Agent, or Firm* — Nath, Goldberg & Meyer; Joshua B. Goldberg

(57) ABSTRACT

The sock pairing system includes a loop that is attached adjacent the top edge of socks and is used to attach pairs of socks to keep a plurality of socks sorted during laundering. The effective length of the loop is the length of the loop between the ends of the loop that are attached to the sock. The effective length of the loop is selected based on the type of sock to which the sock pairing system is attached. The sock pairing system may also include an optional pocket. In its extended position the loop extends out of the pocket, and in its tucked position the loop is tucked into the pocket. The pockets may also be color-coded, such that pairs of socks can be readily identified from a plurality of socks, should the socks become separated prior to or during laundering.

4 Claims, 5 Drawing Sheets

(56) References Cited

U.S. PATENT DOCUMENTS 3,168,747 A * 2/1965 Rothman ..... A41B 1/10 2/128
3,601,818 A * 8/1971 Chesebro ..... A41B 11/00 66/171
4,038,699 A * 8/1977 Burn ..... A41B 11/006 66/189
4,961,235 A * 10/1990 Williger ..... A41B 11/006 2/919
5,027,440 A * 7/1991 Morris ..... A41B 11/006 2/253
5,133,091 A * 7/1992 del Valle Mas ..... A41B 11/006 2/247
5,299,323 A * 4/1994 Schaefer ..... A41D 1/06 2/243.1
5,357,660 A * 10/1994 Smith ..... G09F 3/12 40/633
5,579,541 A * 12/1996 Christy ..... A41B 11/002 2/912
5,625,904 A * 5/1997 Kline ..... A41B 11/006 2/409
5,651,142 A * 7/1997 del Valle Mas ..... A41B 11/006 2/247
5,704,070 A * 1/1998 Stogner ..... A42B 1/241 2/181.2
5,740,558 A * 4/1998 Messman ..... A41B 11/002 2/239
5,918,318 A * 7/1999 Jones ..... A41B 11/002 2/160
5,950,240 A * 9/1999 Carpenter ..... A41D 19/0041 2/160
6,032,294 A * 3/2000 Dean ..... A41B 11/002 2/239
6,067,659 A * 5/2000 Reichle ..... A41B 11/002 2/239
6,199,216 B1 * 3/2001 Weatherspoon ..... A41B 11/006 2/247
6,247,183 B1 * 6/2001 Haas-Laursen ..... A41F 13/00 2/239
6,543,063 B2 * 4/2003 Greer ..... A41B 11/00 2/409
6,775,849 B1 * 8/2004 Messman ..... A41B 11/002 2/239
D560,064 S * 1/2008 Tustin ..... D2/980
8,359,671 B1 * 1/2013 Glass ..... A44B 11/005 2/239
D696,507 S * 12/2013 Tharp ..... D2/857
10,194,699 B2 * 2/2019 De ..... A41B 11/02
D854,309 S * 7/2019 Stuart ..... D2/980
10,633,787 B1 * 4/2020 Pham ..... D06F 95/008
D920,655 S * 6/2021 Genao ..... D2/980
2004/0123377 A1 7/2004 Ferguson
2004/0123430 A1 7/2004 Ferguson
2004/0154075 A1 8/2004 Ferguson
2004/0216219 A1 11/2004 Brevoort
2004/0237174 A1 * 12/2004 Papel ..... A41B 11/006 2/239
2005/0020982 A1 * 1/2005 Shaw ..... A61M 25/02 604/179
2005/0086726 A1 * 4/2005 Poole ..... A41B 11/002 2/239
2006/0200894 A1 * 9/2006 Woodhouse ..... A41B 11/006 2/409
2007/0033712 A1 * 2/2007 Woodhouse ..... A41B 11/006 2/239
2007/0196606 A1 * 8/2007 Cosme ..... A41B 11/002 428/36.1
2008/0034478 A1 * 2/2008 Patterson ..... A41B 11/002 2/239
2008/0222778 A1 * 9/2008 Dierssen-Morice ..... D06F 95/008 2/243.1
2011/0209268 A1 * 9/2011 Smitherman ..... A41B 11/002 2/266
2011/0296588 A1 * 12/2011 Cummings ..... A41B 11/006 2/239
2012/0167276 A1 * 7/2012 Brosie ..... A41B 11/002 2/239
2012/0311768 A1 * 12/2012 Ladyzhenskaya ... A41B 11/002 2/239
2014/0090149 A1 * 4/2014 Zuiderveen ..... A41B 11/002 2/239
2014/0304895 A1 * 10/2014 Stuart ..... A41B 11/002 2/239
2014/0352024 A1 * 12/2014 Echigoya ..... A41D 27/20 2/248
2015/0096106 A1 * 4/2015 Bell ..... A41B 11/006 2/243.1
2016/0227851 A1 * 8/2016 Le Blanc ..... A41D 19/0082
2016/0270453 A1 * 9/2016 Barrett ..... A41B 11/002
2017/0260686 A1 * 9/2017 Farnsworth ..... D06F 95/008
2018/0064190 A1 * 3/2018 Khan ..... A42B 1/048
2019/0059455 A1 * 2/2019 Vaughn ..... A41B 11/006
2020/0236908 A1 * 7/2020 Lagarde ..... A01K 27/003
2020/0383386 A1 * 12/2020 Wanigaratne ..... A41B 11/006
2020/0384308 A1 * 12/2020 Lopez ..... A41D 27/20
2021/0068471 A1 * 3/2021 Giorgi ..... A41B 11/004
2021/0186122 A1 * 6/2021 Price ..... A41B 11/04
2021/0345716 A1 * 11/2021 Bedrosian ..... A41D 19/0058

* cited by examiner

SOCK PAIRING SYSTEM

CROSS-REFERENCE TO RELATED APPLICATION

This application claims the benefit of U.S. Provisional Patent Application No. 63/153,738, filed on Feb. 25, 2021.

BACKGROUND

1. Field

The disclosure of the present patent application relates generally to footwear, such as socks and hose, and particularly to a sock pairing system.

2. Description of the Related Art

Some sock pairing systems may include a loop or open pocket/elastic member, as shown and described in my prior U.S. Patent Publication No. US 2004/0123377, published Jul. 1, 2004. Examples of such sock pairing systems are shown in FIGS. 6-8, below. In FIG. 6, the sock pairing system includes inner loops IL having their ends LE attached and extending from the inner surface of cuffs C of both the left A and right B sock of a pair of socks. In FIG. 7, the sock pairing system includes outer loops OL having their ends LE attached and extending from the outer surface of cuffs C of both the left A and right B sock of a pair of socks. FIG. 8 shows a sock pairing system that connects the two socks A, B, by inserting one sock (in this example, the right sock B) into the loop IL of the other sock (in this example, the left sock A). While such sock pairing systems are useful for keeping a pair of socks together during washing and drying of the socks, they may be improved upon. Such sock pairing systems do not take into consideration the size of the socks. For larger socks, it may be difficult to insert one sock into the loop of the other. For smaller socks, the loops may not be small enough to keep the socks together during rigorous wash cycles. In addition, the outer loops OL are visible and therefore present poor aesthetics when the cuff C of the socks A, B are visible. The inner loops IL are not visible when tucked into the sock, but may be uncomfortable, as they scrape against the skin of the wearer. Thus, a sock pairing system solving the aforementioned problems is desired.

SUMMARY

The sock pairing system includes a loop that is attached adjacent the top edge of each sock in a pair of socks and is used to attach the pair of socks to keep the socks sorted during laundering. The effective length of each loop is the length of the loop between the ends of the loop that are attached to the sock. The loops may be circular (cords) or rectangular (strips) in cross-section and may be in the form of nylon elastic strings to provide strength and comfort should the strings contact the skin of the wearer. The effective length of the loop is selected based on the type of sock to which the sock pairing system is attached. The type of sock may include such attributes as the thickness of the material of the sock, the height of the sock, the size of sock, and other attributes that can affect the ability to pass a single sock through a loop attached to the other sock of the pair. The sock pairing system may also include an optional pocket. In an extended position, the loop extends out of the pocket in order to be looped around the other sock of a pair of socks. In a tucked position, the loop is tucked into the pocket to hide the loop from view or to protect the skin of the wearer. The pockets may be made of elastic nylon and may be dimensioned and configured according to the type of sock to which they are attached. The pockets may also be color-coded, such that one pair of socks can be readily identified in a pile of socks, should the socks become separated prior to or during laundering. The colors may also be used to identify the owner or wearer of the sock, when the socks of several individuals are laundered together.

These and other features of the present subject matter will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
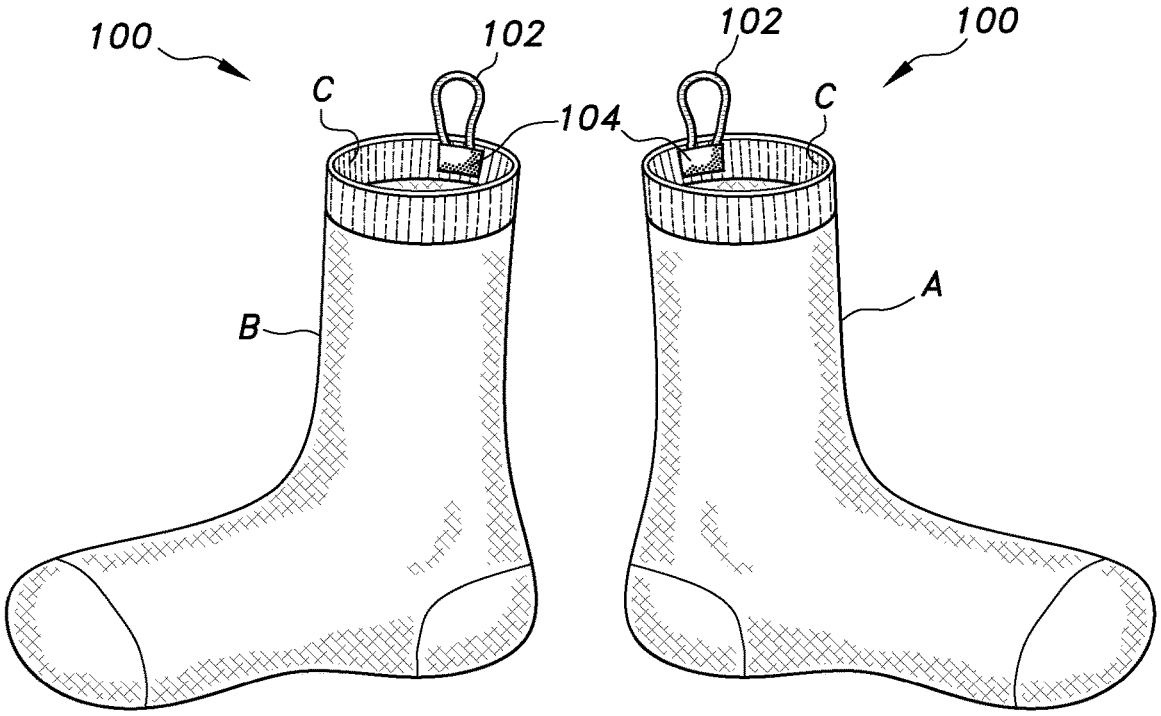
FIG. 1 is a perspective view of a pair of socks in a sock pairing system having loops and a pocket attached to an inner surface of the cuff of each of the socks.
Figure 2:
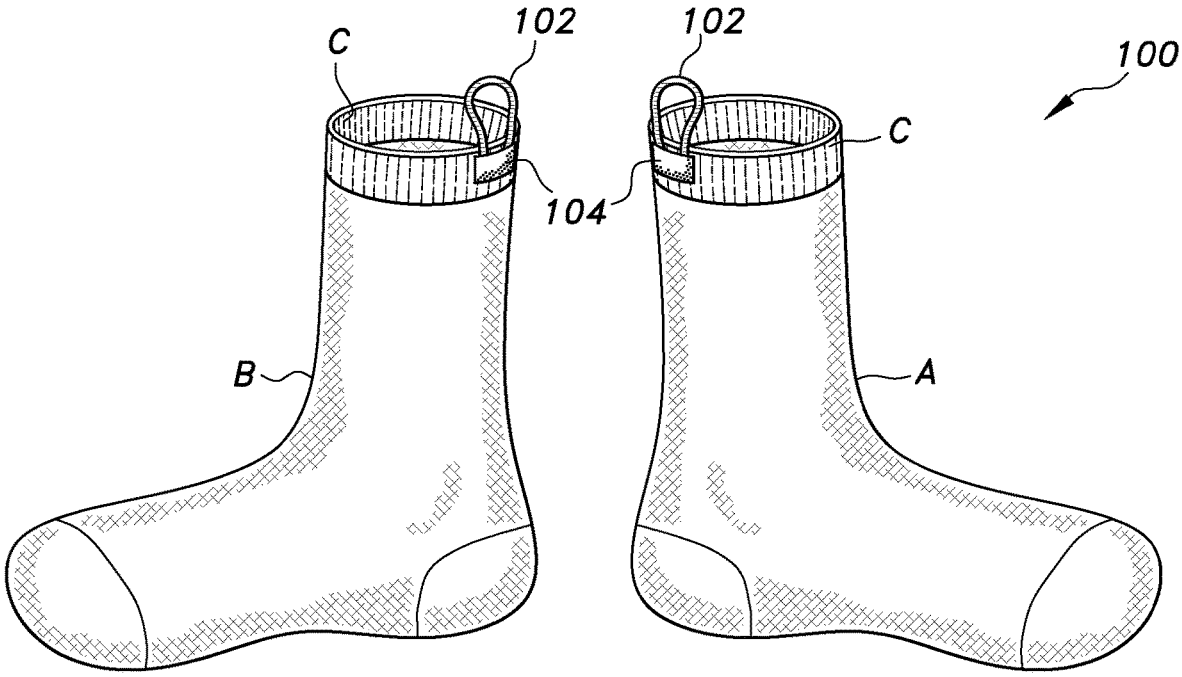
FIG. 2 is a perspective view of a pair of socks in a sock pairing system having loops and a pocket attached to an outer surface of the cuff of each of the socks.
Figure 3:
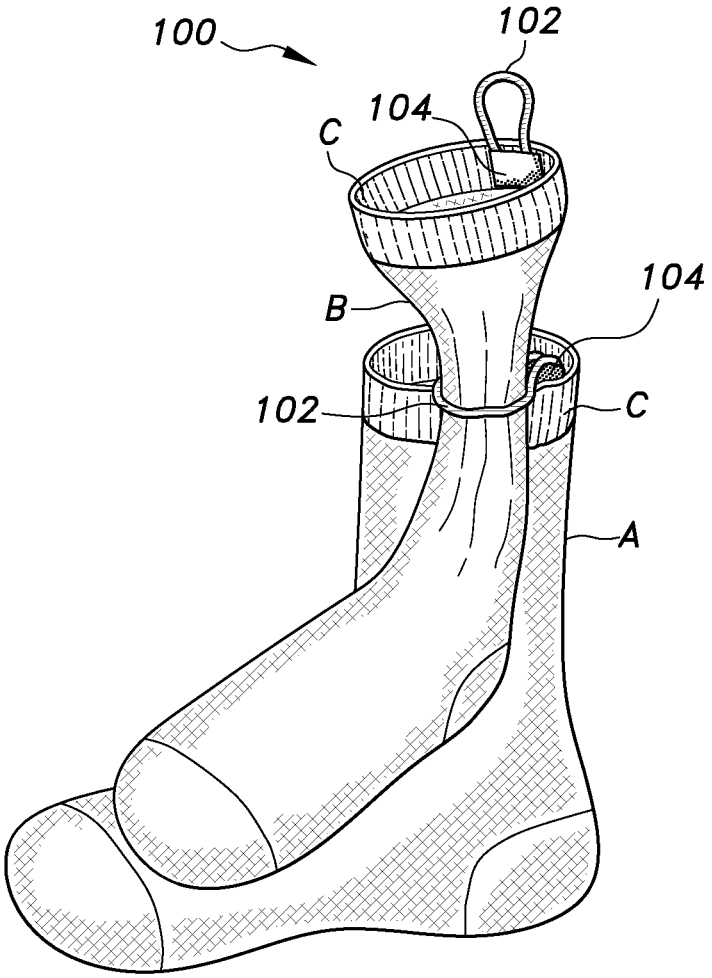
FIG. 3 is a perspective view of the pair of socks of FIG. 1, showing the socks connected using the sock pairing system.
Figure 4:
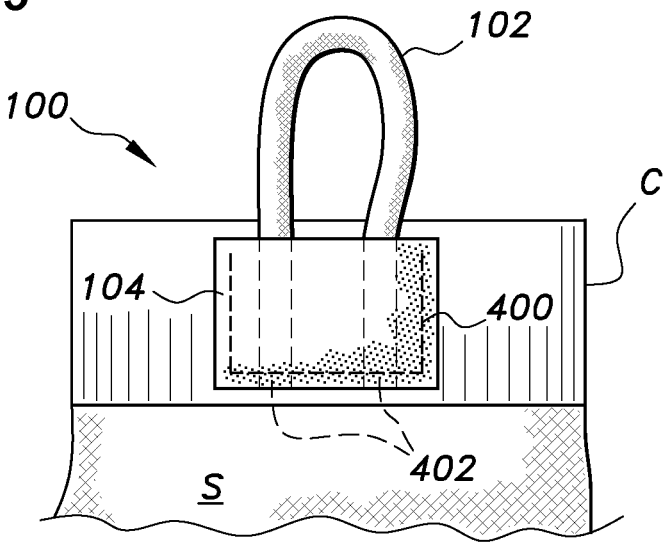
FIG. 4 is an enlarged partial perspective view of the sock pairing system of FIG. 2, showing a loop of the sock pairing system extending out of a pocket of the sock pairing system.

The sock pairing system 100 is shown in FIGS. 1-5. In FIG. 1, the sock pairing system 100 is attached to the inside of the cuffs C of a pair of socks, including a left sock A and a right sock B. It should be understood that as with most socks, the left sock A and the right sock B are identical to one another and the terms left and right are used simply to represent a pair of socks A, B. It should also be understood that the sock pairing system 100 can be used with socks not having cuffs, in which case the sock pairing system 100 is attached to the body of the sock, adjacent its top edge. In FIG. 2, the sock pairing system 100 is attached to the outside of the cuffs C of the socks A, B. As is shown in FIG. 3, to attach the socks to one another for laundering purposes, one of the socks B is guided through the loop 102 of the other sock A. The effective length of the loop 102 is the length of the loop 102 between the stitch line(s) 400 that attach the ends 402 of the loop 102 to the sock S, as shown in FIG. 4. It should be noted that while the loops 102 are shown as circular or round in cross section, other cross sectional shapes, such as rectangular (strips) or flat, could be used. In one embodiment, the loops 102 are nylon elastic strings with circular cross sections 3 mm in diameter, to provide strength and comfort should the strings contact the skin of the wearer.

Figure 9:
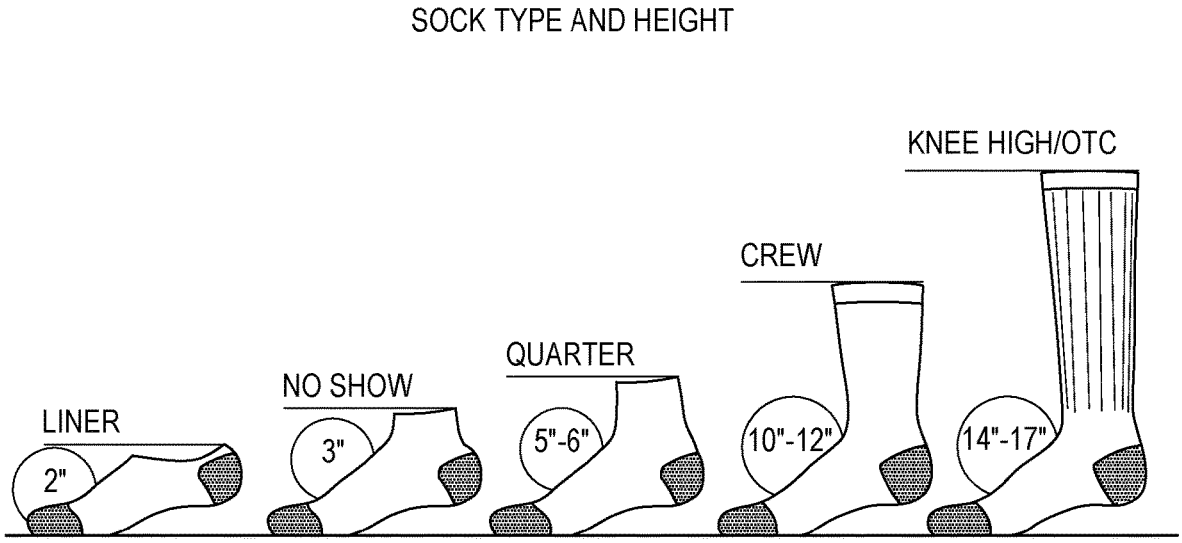
(PRIOR ART) FIG. 9
FIG. 9 is a chart showing different size socks that can be equipped with the sock pairing system of FIGS. 1 and 2.

FIG. 9 shows a number of different sock types that can incorporate the sock pairing system 100. If the effective length of the loop 102 of the sock pairing system 100 is too short for the larger sock types, it can be difficult to guide one sock into the loop 102 of the other. If the effective length of the loop 102 of the sock pairing system 100 is too long for the smaller sock types, the socks may become separated during the laundering process. To avoid this issue, the effective length of the loop 102 of the sock pairing system 100 is selected based on the type of sock to which the sock pairing system 100 is attached. The type of sock can include such attributes as the thickness of the material of the sock, the height of the sock, the size of sock, and other attributes that can affect the ability to pass the sock through a loop. For example, for the "liner" sock, an effective length for the loops is 2.6 cm, and a loop (strip) width of 0.635 cm. An example of a larger size sock is the "crew" sock, wherein an effective length for the loops is 3.5-4.0 cm, and a loop (strip) width of 0.635 cm. These are only examples, and it should be understood that the effective lengths, cross sections and widths of the loops 102 can be determined through experimentation.

Figure 5:
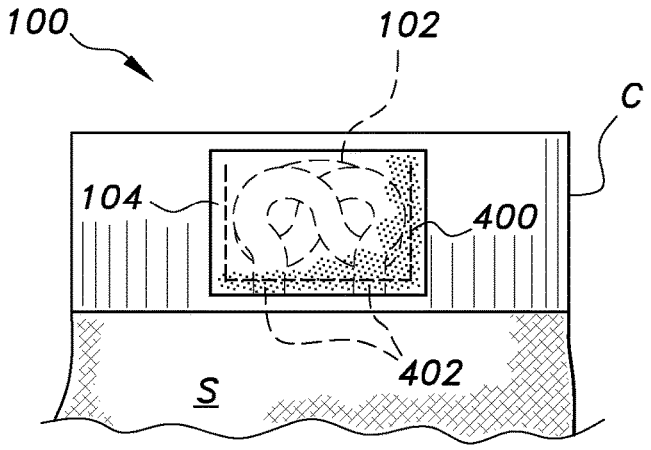
FIG. 5 is an enlarged partial perspective view of the sock pairing system of FIG. 2, showing the loop of the sock pairing system tucked into the pocket of the sock pairing system.
Figure 6:
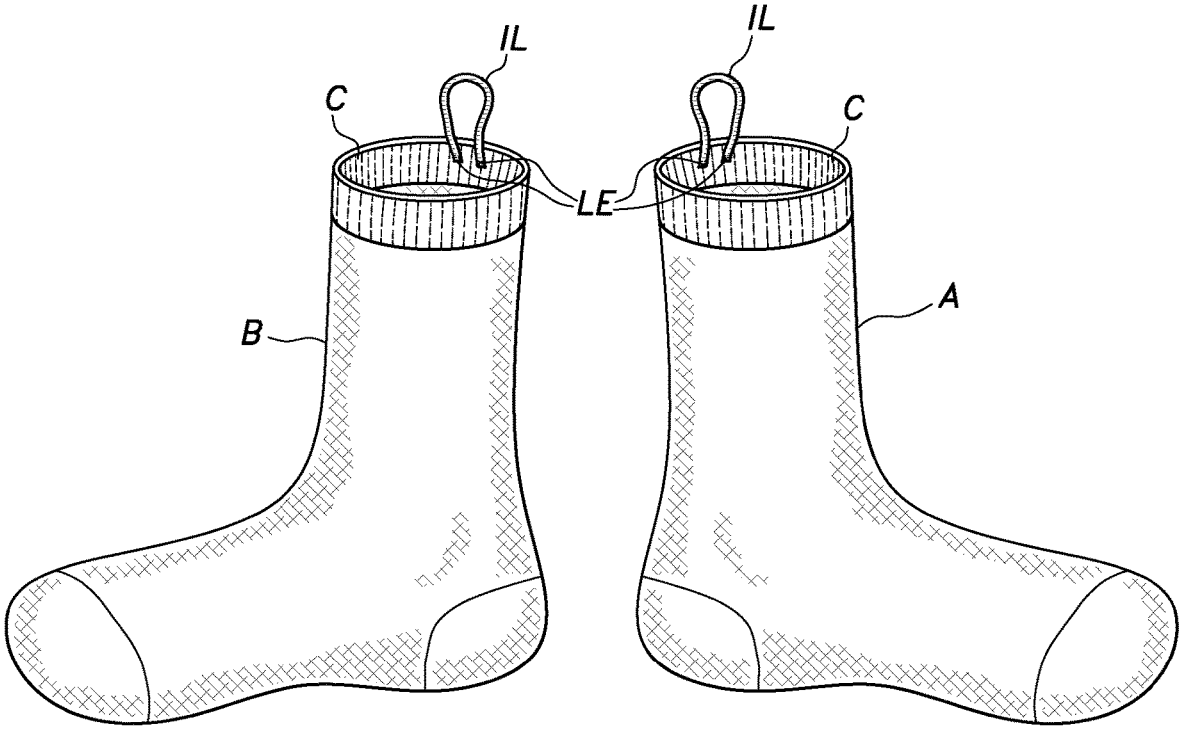
(PRIOR ART) FIG. 6
FIG. 6 is a perspective view of a pair of socks of an exemplary sock pairing system of the prior art having a loop extending from an inner surface of a cuff of the socks.
Figure 7:
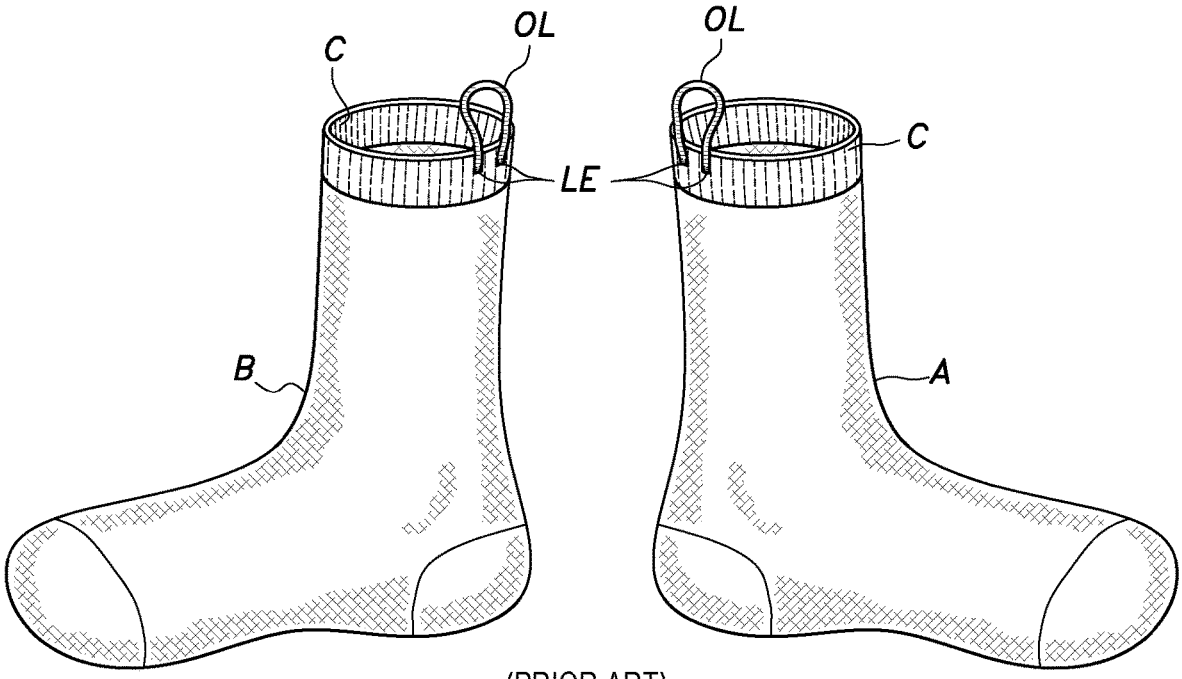
(PRIOR ART) FIG. 7
FIG. 7 is a perspective view of a pair of socks of an exemplary sock pairing system of the prior art having loops extending from an outer surface of a cuff of the socks.
Figure 8:
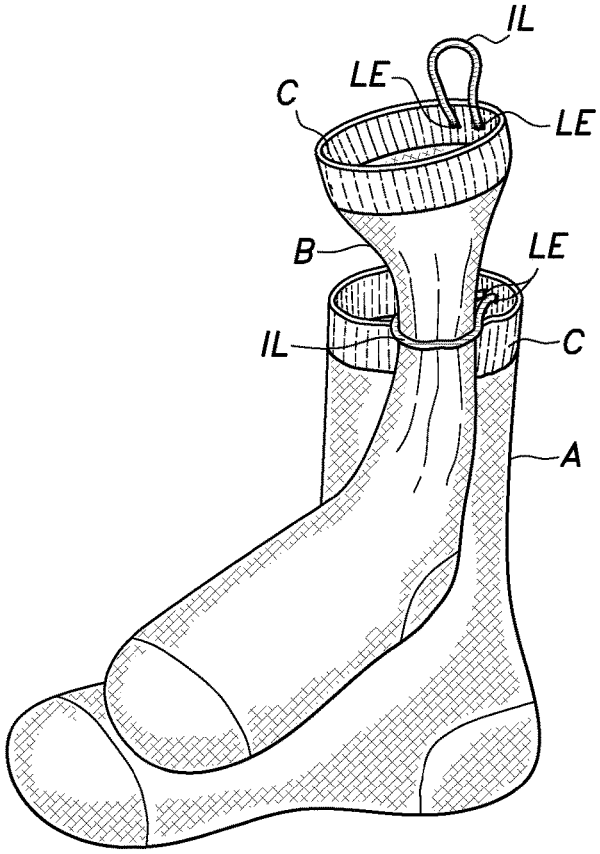
(PRIOR ART) FIG. 8
FIG. 8 is a perspective view of the pair of socks of FIG. 6, showing the socks connected using the prior art sock pairing system.

The details of the sock pairing system 100 are shown in FIGS. 4-5. The sock pairing system 100 includes an optional pocket 104. The pocket 104 is formed by stitching 400 that attaches the two side edges and the bottom edge of the pocket 104 to the cuff C (or the top of a sock without a cuff). The ends 402 of the loop 102 can be anchored to the pocket 104 and the sock by the bottom seam of stitching 400. As shown in FIG. 1, the loops 102 and the pockets 104 may be sewn to the inside of the cuff C, or inside tops of the socks A, B. Alternatively, as shown in FIG. 2, the loops 102 and the pockets 104 may be sewn to the outside of the cuff C, or outside tops of the socks A, B. In FIG. 4, the loop 102 is shown in its extended position, extending out of the pocket 400. In this position, the loop 102 is in position to be looped around the other sock of the pair of socks A, B. In FIG. 5, the loop 102 is shown in its tucked position, tucked into the pocket 104. In this position, the loop 102 is hidden from view in the external embodiment as shown in FIG. 2, thereby providing a more aesthetic appearance. In the internal embodiment as shown in FIG. 1, the pocket 104 is between the loop 102 and the wearer's skin, thereby protecting the skin from possible irritation. In one embodiment, the pockets 104 may be made of elastic nylon, similar to the loops 102. As with the loops 102, the pockets 104 may be sized according to the type of sock to which they are attached. The pockets 104 may also be color-coded, such that pairs of socks can be readily identified from a plurality of socks, should the socks become separated prior to or during laundering. The colors may also be used to identify the owner or wearer of the sock, when the socks of several individuals are laundered together.

It is to be understood that the sock pairing system is not limited to the specific embodiments described above but encompasses any and all embodiments within the scope of the generic language of the following claims enabled by the embodiments described herein, or otherwise shown in the drawings or described above in terms sufficient to enable one of ordinary skill in the art to make and use the claimed subject matter.

I claim:

1. A sock pairing system for attachment to a sock, the sock pairing system comprising a loop having two ends adapted for attachment to the sock and an effective length between the loop's two ends, the sock having a type, the effective length of the loop being dependent on the sock type;

wherein the sock pairing system further comprises the sock, wherein:

the sock is made of a material having a thickness and has a height and a size; and the type of sock is related to the thickness of the material of the sock, the height of the sock, and the size of sock;

wherein the sock pairing system further comprises a pocket, wherein:

the loop may be in an extended position in which the loop extends out of the pocket, the loop may be in a tucked position in which the loop is tucked inside the pocket, the pocket includes two side edges and a bottom edge; and the pocket is attached to the sock by stitching that extends along and attaches the two side edges and the bottom edge of the pocket to the sock; and wherein the stitching extending along the bottom edge of the pocket also attaches the two ends of the loop to the sock.

2. The sock pairing system as recited in claim 1, wherein the pocket is color-coded to identify pairs of socks from a plurality of socks.

3. The sock pairing system as recited in claim 1, wherein the pocket is color-coded to identify types of socks from a plurality of socks.

4. The sock pairing system as recited in claim 1, wherein the pocket is color-coded to identify socks belonging to a particular wearer from a plurality of socks.

* * * * *